United States Patent [19]

Rivas et al.

[11] Patent Number: 4,793,412

[45] Date of Patent: Dec. 27, 1988

[54] CENTRALIZER FOR A POLISHED BAR AND/OR A SUBSTANCE PUMP PISTON STEM

[75] Inventors: Olegario Rivas; Alejandro Newski, both of Miranda, Venezuela

[73] Assignee: Intevep, S.A., Caracas, Venezuela

[21] Appl. No.: 98,553

[22] Filed: Sep. 21, 1987

[51] Int. Cl.[4] ..... E21B 17/10

[52] U.S. Cl. ..... 166/241; 175/325

[58] Field of Search ..... 166/241, 176; 175/325

[56] References Cited

U.S. PATENT DOCUMENTS

| | | | |
|---|---|---|---|
| 712,487 | 11/1902 | Black | 175/325 |
| 712,488 | 11/1902 | Black | 175/325 |
| 712,901 | 11/1902 | Black | 175/325 |
| 713,723 | 11/1902 | Vinzent | 175/325 |
| 1,281,756 | 10/1918 | Black | 175/325 |
| 1,827,835 | 10/1931 | Black | 175/325 |
| 2,198,720 | 4/1940 | Edgecomb et al. | 175/325 |
| 2,466,239 | 4/1949 | Holcombe | 166/176 |
| 2,601,478 | 6/1952 | Weir . | |
| 2,722,462 | 11/1955 | Tschirley | 166/241 |
| 3,938,853 | 2/1976 | Jurgens et al. | 166/241 X |
| 4,557,327 | 12/1985 | Kinley et al. | 166/241 |
| 4,620,802 | 11/1986 | Harrel | 175/325 |
| 4,621,690 | 11/1986 | Klyne | 166/241 |

*Primary Examiner*—Bruce M. Kisliuk

*Attorney, Agent, or Firm*—Bachman & LaPointe

[57] ABSTRACT

The present invention relates to a device which can be used to centralize a polished bar and/or a piston stem of a subsurface pump within a production pipe. The device comprises an elongate, substantially cylindrical body member having a longitudinal axis of symmetry, a plurality of slots in the member, and a plurality of rotatable members eccentrically mounted in the slots with respect to the longitudinal axis of symmetry for permitting simultaneous contact between the rotatable members and the inner wall of a tubular production pipe.

10 Claims, 1 Drawing Sheet

CENTRALIZER FOR A POLISHED BAR AND/OR A SUBSTANCE PUMP PISTON STEM

CROSS REFERENCE TO RELATED APPLICATION

The instant application is related to the subject matter disclosed and claimed in co-pending application Ser. No. 098,929, filed Sept. 21, 1987.

BACKGROUND OF THE INVENTION

The present invention relates to the production of oil and in particular to a centralizer for centralizing tubular structures and/or tools in a well pipe.

Oil is withdrawn from subterranean formations through a tubular production pipe formed by a string of tubing extending to the surface. The oil is lifted through the pipe by the action of a downhole pump actuated by a string of tubular structures including a plurality of sucker rods and/or at least one polished bar.

In recent years, directional and deviated wells have become very popular in many oil fields. Also, for heavy and extra heavy crude oil steam injection is used to improve oil production. In many of these wells, there is a polished bar that moves through a stuffing box. Frequently this polished bar as well as the piston stem associated with the subsurface or downhole pump fail because the reciprocating forces acting on the sucker rod string are not perfectly aligned and centralized with the stuffing box and/or the subsurface pump. As a result, undesirable radial forces are created which cause non-unifirm wear of the various components and lead to oil spills as well as premature pump failure.

Various devices for centralizing and guiding rods and/or tubular structures such as sucker rods within a tubular production pipe are known in the art. One type of device has a plurality of rollers for contacting the tubular pipe and maintaining a desired spacing between the tubular pipe and the reciprocating tubular structure or tool. U.S. Pat. Nos. 2,466,239 to Holcombe, 2,601,478 to Weir and 4,577,327 to Kinley et al. illustrate such devices.

Centralizing and guiding devices having fixed contact elements are also known in the art. U.S. Pat. No. 2,722,462 to Tschirley illustrates an elastomeric collar having a row of bumps or projections attached to a drill pipe. The projections help to maintain a desired separation between the pipe and the surrounding casing. U.S. Pat. No. 3,938,853 to Jurgens et al. illustrates a similar stabilizer device secured to a drill collar. The device comprises an inner sleeve and an external sleeve with a series of longitudinally extending helical ribs. The primary deficiency of using fixed contact elements such as these is their tendency to quickly wear out due to friction.

More recently, a centralizing device comprising a coupling device having a cylindrical body and a plurality of lenticular wheels positioned within slots in the body has been developed to overcome the frictional problem. To minimize scoring of the tubing wall, the wheel members are formed of a hard, non-abrasive material such as hard nylon. U.S. Pat. No. 4,621,690 to Klyne illustrates such a device.

Many of these devices when tested in wells having a temperature above 500° F. have failed in giving high performance work life. Often, the non-metallic components of the devices are the weak links because they cannot withstand the critical conditions in the oil wells.

In the wheeled devices, failure is also often the result of too few wheels being in contact with the production pipe tubing.

Accordingly, it is an object of the present invention to provide a centralizer which can be used with different oil well structures or tools to centralize the structures within the production pipe.

It is another object of the present invention to provide a centralizer as above which reduces frictional forces between the structures and the surrounding production pipe.

It is a further object of the present invention to provide a centralizer as above capable of withstanding typical oil well service conditions.

These and other objects and advantages will become more apparent from the following description and drawings.

SUMMARY OF THE INVENTION

The present invention relates to a centralizer which can be used to centralize a polished bar and/or the piston stem of a subsurface pump within a production pipe. The centralizing device comprises an elongate, substantially cylindrical body member having a longitudinal axis of symmetry, at least one slot extending through the member, and a rotatable member within each slot mounted eccentrically with respect to the longitudinal axis. In a preferred construction, the body member has a plurality of spaced apart slots and the device includes a plurality of rotatable members within these slots. In a preferred mode of operation, all of the rotatable members are in simultaneous contact with the pipe wall.

The centralizer of the present invention is further characterized by internally threaded, longitudinally extending bores at each end for permitting it to be joined to a plurality of tubular or non-tubular structures. For example, the centralizer could be positioned intermediate a polished bar and a sucker rod to centralize the polished bar within the production pipe as the bar moves within a stuffing box. The centralizer could also be positioned intermediate a sucker rod and a piston stem of a subsurface pump to centralize and properly align them within the production pipe.

It has been found that the centralizer of the present invention reduces the undesirable radial frictional forces which can lead to failure of the various structures and tools used in oil well production. Additionally, the centralizer of the present invention may be used in either hot or cold well environments.

DETAILED DESCRIPTION

Figure 1:
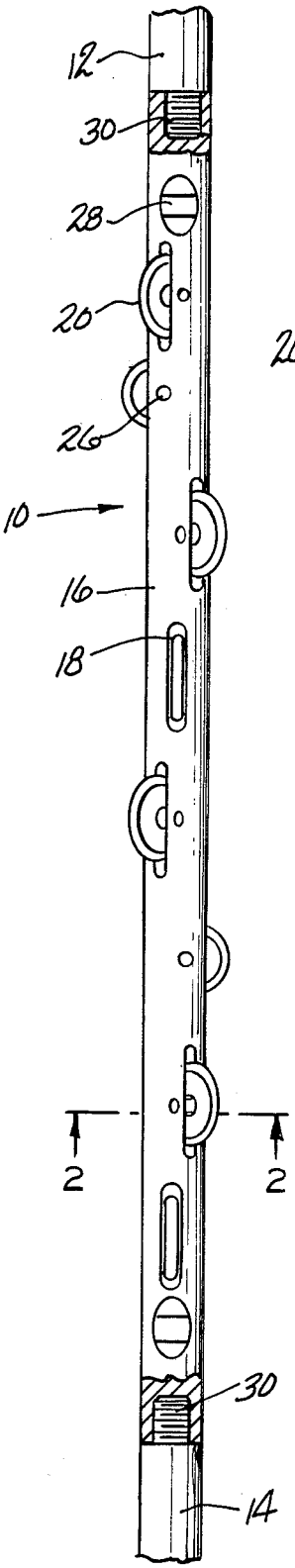
FIG. 1 is a schematic view in partial cross section of the centralizer of the present invention.

As previously discussed, the centralizer 10 of the present invention may be used to position a number of different components or tools within an oil production pipe. For example, it may be located at the bottom connection of a tubular structure 12 such as a polished bar to take any misalignment of the system. It may also be located at the top connection of a tubular structure 14 such as a piston stem to centralize it.

Referring now to the Figures, the centralizer 10 is formed by an elongate, substantially cylindrical body member 16 having any desired length and diameter. For example, the member 16 may be manufactured in diametrical sizes of ¾", ⅞", 1", 1⅛", 1¼" and 1½" to match commercially available polished bars and piston stems. The member 16 may be formed from any material suitable for use in hot and cold wells such as quenched and tempered steel.

The body member 16 is provided with one or more flat surfaces or portions 28 to permit wrenching of the centralizer device. In addition, the member 16 has internally threaded, longitudinally extending boxes 30 at each end for permitting the centralizer to be connected to any desired tool, piece of equipment or tubular structure having mating threaded pin ends.

A plurality of slots 18 are machined within the body member 16 for the purpose of accommodating a plurality of rotatable members 20, such as wheels or rollers, which serve to centralize the centralizer and any connected structures within the production tubing 22. Each slot 18 preferably extends transversely through the member 16 and is oriented so as to have its longitudinal dimension substantially parallel to the longitudinal axis A of symmetry of the member 16. While each slot may have any desired width, it is preferred that it be just slightly wider than the thickness t of a central portion of the rotatable member 20 so as to substantially limit rotation of the member 20 to a plane substantially parallel to the axis A.

The slots 18 extend about the periphery of the body member 16 and in a preferred arrangement are set at an angle of about forty-five degrees between adjacent slots. Also, in this preferred arrangement, they are further arranged so as to form a helicoidal array. It has been found that by providing such an array, the total rotatable member surface area in contact with the production tubing is improved. Further, the forces acting per rotatable member are substantially decreased, thus improving the service life of both the centralizer 10 and the production tubing. Still further, the probability of rotatable member failure is reduced as compared to other arrangements since the forces usually act substantially perpendicular to the rotatable member.

Figure 5:
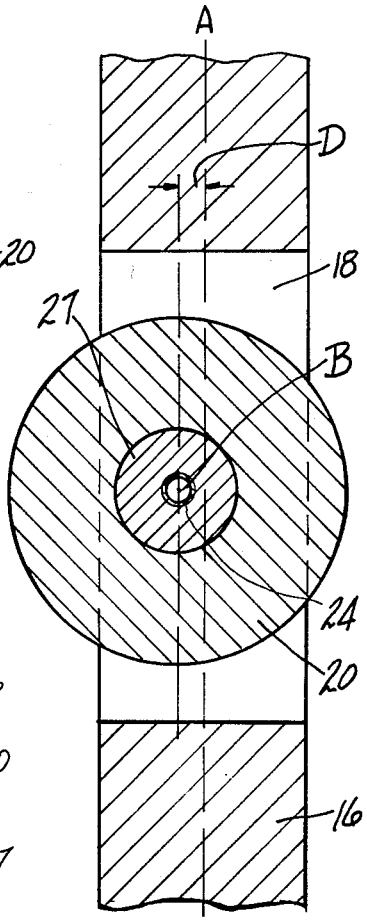
FIG. 5 is a cross-sectional view of a portion of the centralizer of FIG. 1 showing the eccentric mounting of the wheel within a slot.
Figure 2:
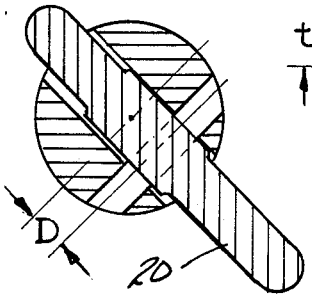
FIG. 2 is a sectional view taken along line A—A in FIG. 1 illustrating a wheel mounted within a slot.

Referring now to FIGS. 2 and 5, a rotatable member 20 is mounted for rotation in each slot 18 about an axis B which is spaced from or eccentric to the longitudinal axis A. The offset distance D between the longitudinal axis A and the rotation axis B is a function of the material forming the rotatable member 20 and the material and diameter of the production pipe 22. For most applications, the offset distance is in the range of from about 1 to about 15 mm, especially from about 5 to about 10 mm.

The rotational axis B for each rotatable member 20 is defined by a pin 24 having its ends positioned in bores 26. Any suitable means (not shown) known in the art may be used to lock pin 24 in position. Preferably, each pin 24 is oriented substantially transverse to the longitudinal axis A as well as the longitudinal dimension of the slot. While the pin 24 may be formed from any suitable material known in the art, it is preferred to form the pin from quenched and tempered steel.

Each rotatable member 20 is mounted for rotation about the stationary pin 24 by a plain cast iron bearing 27. It has been found that the use of such a bearing improves the service life of the rotatable member in part as a result of the high wear resistance of the bearing.

Figure 6:
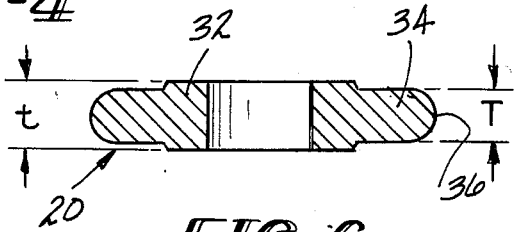
FIG. 6 is a cross-sectional view of a preferred wheel configuration.

Referring now to FIG. 6, the rotatable member 20 has a central portion 32 with a thickness t which is sufficiently large to function as a thrust bearing for minimizing frictional forces between the cylindrical body member 16 and the member 20. The member 20 is further characterized by intermediate portions 34 on each side of the central portion 32 having a thickness T and an end portion 36 which is preferably semi-circular in cross section and which has a radius substantially equal to half of the thickness T. It has been found that by providing such semi-circular end portions the contact area per rotatable member is maximized.

Figure 3:
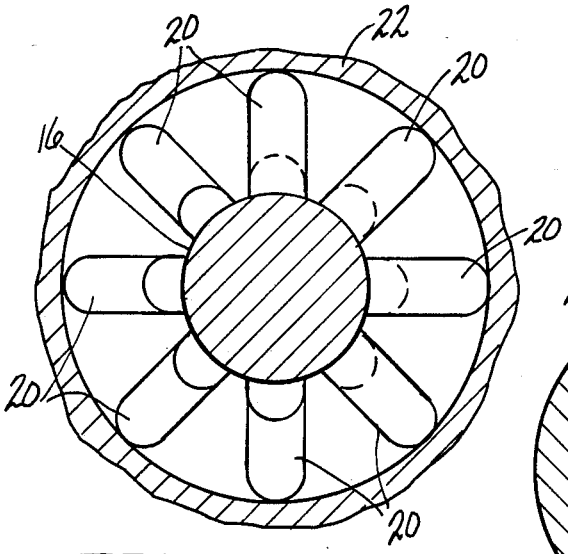
FIG. 3 is a sectional view showing the relationship between the wheels and the production tube.
Figure 4:
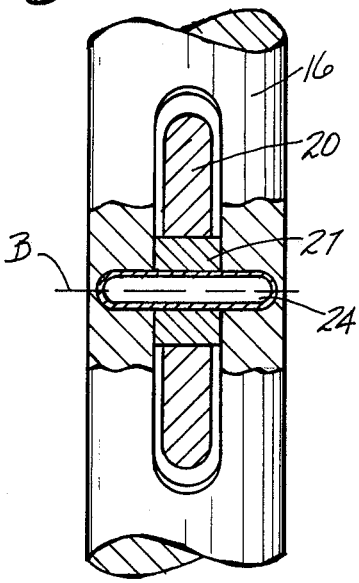
FIG. 4 is a schematic view in partial cross section of a portion of the centralizer of FIG. 1 showing the mounting of a wheel within a slot.

The diameter of each member 20 is of course a function of the offset distance D and the diameter of the tubing 22. As shown in FIG. 3, the centralizer 10 operates by having end portions 36 of the rotatable members 20 in simultaneous contact with the inner wall of the tubing 22.

It has been found that the service life of both the centralizer 10 and the production pipe tubing 22 can be improved by forming each rotatable member 20 from a material having a hardness which at well operating temperatures, generally above 300° F., is from at least about 50 Brinnel Hardness (HB) to about 150 HB, preferably about 50 HB, less than the hardness of the material forming the production tubing. It has been found that by using such a hardness differential damage to the production tubing can be prevented. The rotatable members 20 may be made from a non-ferrous material such as thermosetting and/or thermoplastic polymers or a metallic material such as a ferrous or non-ferrous metal or metal alloy. Suitable metallic materials include, but are not limited to, copper alloys having a hardness in the range of from about 50 HB to about 200 HB and austenitic or ferritic stainless steels such as AISI 316. Of course, the particular material selected for the members 20 depends upon well temperature and corrosiveness, hardness of the production pipe tubing, and well depth. The production pipe tubing 22 may be formed from API J55. In addition to improving service life, it has been found that the aforementioned hardness differential reduces frictional wear of the tubing by the rotatable members.

While the member 16 may have any desired number of slots 18 and the device 10 may have any number of rotatable members 20, it is preferred that there be eight slots and eight rotatable members.

When used as a polished bar centralizer, the device 10 is connected as close as possible to the lower end of the polished bar. When used as a piston stem centralizer, the device 10 is connected as close as possible to the piston stem of the subsurface pump not shown.

It is apparent that there has been provided in accordance with this invention a centralizer for a polished bar and/or a subsurface pump piston stem which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A device for centralizing structures within a production pipe for withdrawing oil from a subterranean formation which comprises an elongate, substantially cylindrical body member having a longitudinal axis of symmetry, at least one slot extending laterally through said member, and a rotatable member mounted within each said slot for rotation about an axis located within said cylindrical body and eccentrically located with respect to said longitudinal axis for contacting a wall of said pipe to centralize said structures within said pipe wherein each rotatable member is mounted for rotation about said axis which is substantially transverse to said longitudinal axis and each rotatable member lies in a plane substantially parallel to a plane containing said longitudinal axis.

2. A device as set forth in claim 1 further comprising a plurality of slots and an eccentrically mounted rotatable member in each said slot.

3. A device as set forth in claim 2 wherein all of said rotatable members are in simultaneous contact with said pipe wall.

4. A device as set forth in claim 1 wherein each rotational axis is defined by a pin mounted within said body member.

5. A device as set forth in claim 4 further comprising each rotatable member being mounted for rotation on said pin by a cast iron plain bearing.

6. A device as set forth in claim 2 wherein each rotatable member is formed from a material having a hardness which is at least about 50 Brinnel Hardness less than the hardness of the material forming said production pipe to protect said production pipe.

7. A device as set forth in claim 1 further comprising said body member having internally threaded longitudinally extending bores at each end for joining said device to a plurality of tubular structures.

8. A device as set forth in claim 7 wherein one of said tubular structures is a polished bar and the other of said tubular structures is a sucker rod and wherein said device centralizes said polished bar.

9. A device as set forth in claim 7 where one of said tubular structures is a sucker rod and the other of said tubular structures is a piston stem for a subsurface pump and wherein said device centralizes said piston stem.

10. A device as set forth in claim 2 wherein each said rotatable member has a semi-circular end portion in order to provide a relatively large surface contact area.

* * * * *